United States Patent [19]

Byrd et al.

[11] Patent Number: 5,066,380

[45] Date of Patent: Nov. 19, 1991

[54] ELECTROCATALYTIC CATHODES AND METHOD OF PREPARATION

[75] Inventors: Carl E. Byrd, Richwood; Stephen L. Kelly, Angleton; Richard N. Beaver, Angelton, all of Tex.

[73] Assignee: The Dow Chemical Company, Midland, Mich.

[21] Appl. No.: 529,829

[22] Filed: May 29, 1990

[51] Int. Cl.[5] ..... C25B 11/08; B05D 5/12

[52] U.S. Cl. ..... 204/290 R; 427/125; 427/255.4; 427/383.7; 427/436

[58] Field of Search ..... 204/290 R, 291, 292, 204/293; 502/101; 427/77, 125, 123, 436, 255.4, 383.1, 383.3, 383.7

[56] References Cited

U.S. PATENT DOCUMENTS

| | | | |
|---|---|---|---|
| 3,751,296 | 8/1973 | Beer | 204/290 F |
| 4,238,311 | 12/1980 | Kasuya | 204/290 R |
| 4,313,814 | 2/1982 | Saito et al. | 204/290 F |
| 4,414,071 | 11/1983 | Cameron et al. | 204/242 |
| 4,443,317 | 4/1984 | Kawashima et al. | 204/290 F |
| 4,572,770 | 2/1986 | Beaver et al. | 204/98 |
| 4,584,085 | 4/1986 | Beaver et al. | 204/290 R |
| 4,760,041 | 7/1988 | Beaver et al. | 502/101 |

FOREIGN PATENT DOCUMENTS

| | | |
|---|---|---|
| 0129088 | 5/1984 | European Pat. Off. . |
| 0129374 | 5/1987 | European Pat. Off. . |
| 0129231 | 1/1988 | European Pat. Off. . |
| 77-011178 | of 1977 | Japan . |

OTHER PUBLICATIONS

Kirk-Othmer *Ency. of Chem. Technology*, 3rd Ed. (John Wiley & Sons 1978), pp. 799-975.

W. J. Moore, *Physical Chemistry*, (Prentice Hall 1962), 3rd Ed., pp. 406-408.

*Primary Examiner*—John F. Niebling

*Assistant Examiner*—Kathryn Gorgos

[57] ABSTRACT

Cathodes useful in electrolytic cells, such as a chlor-alkali cell, are disclosed which have a metallic-surfaced substrate coated with an electrocatalytic coating. The electrocatalytic coating includes palladium and at least one primary electrocatlaytic metal, such as a platinum group metal. The coating optionally includes at least one secondary electrocatalytic metal, such as nickel, cobalt, iron, copper, manganese, molybdenum, cadmium, chromium, tin and silicon. Also disclosed is a non-electrolytic reduction method for preparing the cathodes. The method provides a tightly adherent coating, improves electrocatalyst loading and reduces cathode production costs.

25 Claims, 1 Drawing Sheet

ELECTROCATALYTIC CATHODES AND METHOD OF PREPARATION

FIELD OF THE INVENTION

This invention concerns electrocatalytic cathodes useful in an electrolysis cell, such as a chlor-alkali cell. The invention also concerns a method for preparing the cathodes.

BACKGROUND OF THE INVENTION

There are three types of electrolytic cells commercially used for producing halogen gas and aqueous caustic solutions from alkali metal halide brines, a process referred to by industry as a chlor-alkali process. The three types of cells are: (1) a mercury cell, (2) a diaphragm cell and (3) a membrane cell. The general operation of each cell is known to those skilled in the art and is discussed in Volume 1 of the *Kirk-Othmer Encyclopedia of Chemical Technology*, (John Wiley & Sons-3rd Ed. 1978) at page 799 et. seq., the relevant portions of which are incorporated herein by reference.

The three cells differ in various respects. In the mercury cell, alkali metal ions produced by electrolysis of an alkali metal salt form an amalgam with mercury. The amalgam reacts with water to produce aqueous sodium hydroxide, hydrogen gas and free mercury. The mercury is recovered and recycled for further use as a liquid cathode. In a diaphragm cell, an alkali metal halide brine solution is fed into an anolyte compartment where halide ions are oxidized to produce halogen gas. Alkali metal ions migrate into a catholyte compartment through a hydraulically-permeable microporous diaphragm disposed between the anolyte compartment and the catholyte compartment. Hydrogen gas and aqueous alkali metal hydroxide solutions are produced at the cathode. Due to the hydraulically-permeable diaphragm, brine may flow into the catholyte compartment and mix with the alkali metal hydroxide solution. A membrane cell functions similar to a diaphragm cell, except that the diaphragm is replaced by a hydraulically-impermeable, cationically-permselective membrane which selectively permits passage of hydrated alkali metal ions to the catholyte compartment. A membrane cell produces aqueous alkali metal hydroxide solutions essentially uncontaminated with brine. Presently, the most widely used chlor-alkali processes employ either diaphragm or membrane cells.

The minimum voltage required to electrolyze sodium chloride brine into chlorine gas, hydrogen gas, and an aqueous sodium hydroxide solution may be theoretically calculated by the use of thermodynamic data. However, in reality, production at the theoretical voltage is not attainable and a higher voltage, i.e., a so-called overvoltage, must be applied to overcome various inherent resistances within the cell. Reduction in the amount of applied overvoltage leads to a significant savings of energy costs associated with cell operation. A reduction of even as little as 0.05 volts in the applied overvoltage translates to significant energy savings when processing multimillion-ton quantities of brine. As a result, it is desirable to discover methods which will minimize overvoltage requirements.

Throughout the development of chlor-alkali technology, various methods have been proposed to reduce the overvoltage requirements. To decrease the overvoltage in a diaphragm or a membrane cell, one may attempt to reduce electrode overvoltages, i.e., a so-called hydrogen overvoltage at the cathode; to reduce electrical resistance of the diaphragm or membrane; to reduce electrical resistance of the brine being electrolyzed; or to use a combination of these approaches. Some research concentrates on minimizing cell overvoltage by proposing design modifications to the cells.

It is known that the overvoltage for an electrode is a function of its chemical characteristics and current density. See, W. J. Moore, *Physical Chemistry*, pp. 406–408 (Prentice Hall, 3rd ed. 1962). Current density is defined as the current applied per unit of actual surface area on an electrode. Techniques which increase the actual surface area of an electrode, such as acid etching or sandblasting the surface of the electrode, result in a corresponding decrease of the current density for a given amount of applied current. Inasmuch as the overvoltage and current density are directly related to each other, a decrease in current density yields a corresponding decrease in the overvoltage. The chemical characteristics of materials used to fabricate the electrode also impact overvoltage. For example, electrodes incorporating an electrocatalyst accelerate kinetics for electrochemical reactions occurring at the surface of the electrode.

It is known that certain platinum group metals, such as ruthenium, rhodium, osmium, iridium, palladium, platinum, and oxides thereof are useful as electrocatalysts. Electrodes may be fabricated from these metals, but more economical methods affix the platinum group metals to a conductive substrate such as steel, nickel, titanium, copper and so on. For example, U.S Pat. No. 4,414,071 discloses coatings of one or more platinum group metals deposited as a metallic layer on an electrically-conductive substrate. Japanese Patent No. 9130/65-OPI application numbers 131474/76 and 11178/77, refers to use of a mixture of at least one platinum group metal oxide with a second metal oxide as a cathode coating. U.S. Pat. No. 4,238,311 teaches a cathode coating consisting of fine particles of platinum group metals, platinum group metal oxides or a combination thereof, affixed to a nickel substrate.

Industry has recently directed attention toward development of "zero-gap" electrolytic cells wherein an electrode, such as a cathode, is placed in contact with a membrane. This arrangement reduces the required overvoltage of prior "gap" cell designs by elimination of electrical resistance caused by electrolyte being disposed between the cathode and the membrane. In some zero-gap cells, it is advantageous to employ an extremely thin cathode to provide close contact between the cathode and the membrane and, thereby, fully utilize the advantage of the zero-gap cell design. A thin substrate also provides flexibility, which helps prevent damage to the membrane caused by contact with the cathode. However, use of a thin substrate presents problems in maintaining adherence of electrocatalytic coatings to the substrate. Substrates coated by prior methods can experience significant coating loss by decrepitation shortly after being placed in service, especially where the substrate is flexible. Accordingly, it is desirable to develop a coating resistant to loss during operation.

It is also difficult under prior methods to deposit an effective amount of catalyst on the electrode in a single application. Many prior methods, particularly those which prepare platinum group metal oxide coatings, require repeated applications to obtain an effective catalyst loading. In some methods, such as thermal oxidation of platinum group metal compounds placed on an electrode substrate, obtaining an effective amount of catalyst requires as many as eight or more separate applications of the compounds and subsequent thermal treatments. The cost associated with production of such electrodes is, in part, dependent upon labor costs. It is not surprising that such repeated applications greatly increase electrode production costs. A method which exhibits improved catalyst loading, i.e., one wherein an effective amount of catalyst may be applied in one application, would reduce such production costs.

It is, therefore, desirable to develop a method for producing novel low overvoltage cathodes having a coating that is tightly adhered to the underlying substrate and exhibiting improved electrocatalyst loading.

SUMMARY OF THE INVENTION

The objects addressed above are achieved by a method for making an electrocatalytic cathode comprising contacting at least one surface of a metallic-surfaced substrate with a coating solution having a pH of less than about 2.8. The coating solution comprises a solvent medium, at least one primary electrocatalytic metal ion at a concentration sufficient to deposit an effective amount of electrocatalytic metal on the surfaces, and palladium metal ion at a concentration sufficient to promote loading of the electrocatalytic metal on the surfaces. The contact is conducted under conditions and for a time sufficient to deposit on the surfaces a hard, substantially continuous and non-dendritic coating of the electrocatalytic metal and palladium metal as a metal alloy having a substantially uniform composition.

Another aspect is a cathode suitable for use in an electrolytic cell, the cathode comprising a metallic-surfaced substrate having tightly adhered thereto a hard, substantially continuous and non-dendritic coating of electrocatalytic metal. The coating has a substantially uniform composition and comprises a metal alloy of palladium and at least one electrocatalytic metal selected from the group consisting of ruthenium, rhodium, osmium, iridium and platinum.

DETAILED DESCRIPTION OF THE INVENTION

Figure 1:
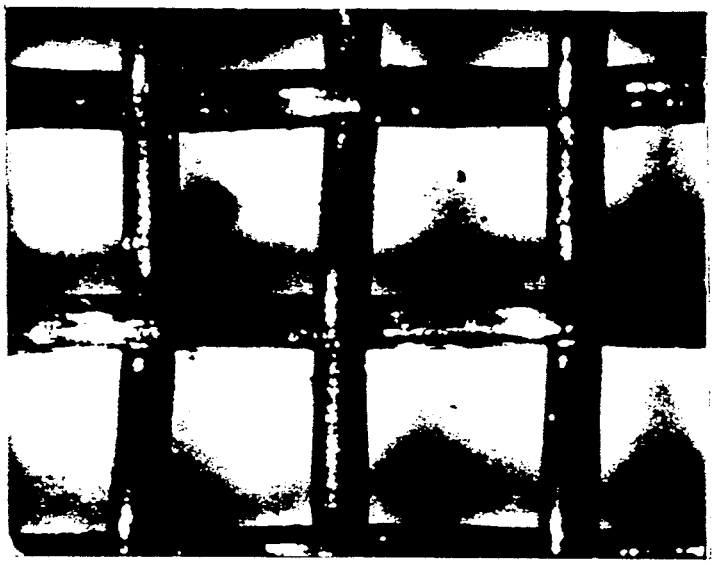
FIG. 1 is a photomicrograph illustrating a coating obtained according to the present invention which exhibits a shiny, hard, substantially continuous and non-dendritic surface deposit. The coating is discussed in connection with Example 2.

The present invention is a method for preparing an electrocatalytic cathode by depositing suitable electrocatalysts onto a metallic-surfaced substrate using a non-electrolytic reduction deposition method. It has been discovered that including palladium ions in a coating solution having a pH of less than about 2.8 promotes deposition of electrocatalytic metal ions from the solution onto a metallic-surfaced substrate in contact with the solution. The method yields a hard, substantially continuous and non-dendritic electrocatalyst coating that is tightly adhered to the substrate. The method and resultant coating are more fully described hereinafter.

Substrates suitable for use in preparing cathodes according to the invention have surfaces of electrically conductive metals. Such metallic-surfaced substrates may be formed of any metal which substantially retains its physical integrity during both preparation of the cathode and its subsequent use in an electrolytic cell. The substrate may be of a ferrous metal, such as iron, steel, stainless steel and other metal alloys wherein a major component is iron. The substrate may also be prepared from non-ferrous metals such as copper and nickel. Nickel is preferred as a cathode substrate, since it is resistant to chemical attack within the basic environment of the catholyte in a chlor-alkali cell. Metal laminates comprising a base layer of either a conductive or non-conductive underlying material, with a conductive metal affixed to the surface of the underlying material, can also be used as a substrate. The means by which the conducting metal is affixed to the underlying material is not critical. For example, a ferrous metal can act as the underlying material and have a layer of a second metal, such as nickel, deposited or welded thereon. Nonconductive underlying materials, such as polytetrafluoroethylene, may be employed when coated with a conductive metal surface onto which electrocatalytic metals are then deposited as described hereinafter. Thus, the metallicsurfaced substrate may be entirely metal or an underlying material having a metallic surface thereon.

The configuration of the metallic-surfaced substrate used to prepare cathodes according to the present invention is not critical. A suitable substrate may, for example, take the form of a flat sheet, a curved surface, a convoluted surface, a punched plate, a woven wire screen, an expanded mesh sheet, a rod, a tube, and so on. Preferred substrate configurations are a woven wire screen and an expanded mesh sheet. In zero-gap chlor-alkali cells, particularly good results are obtained by use of a thin substrate, for example, a fine woven wire screen made of cylindrical wire strands having a diameter of about 0.010 inches. Other electrolytic cells may employ cathodes of mesh sheets or flat plate sheets which are bent to form "pocket" electrodes having substantially parallel sides in a spaced-apart relationship, thereby substantially forming a U-shape when viewed in cross section.

The metallic-surfaced substrate is preferably roughened prior to contact with the coating solution in order to increase the effective surface area of the resulting cathode. This roughened effect is still evident after deposition of electrocatalytic metal on the substrate as disclosed herein. As previously described, an increased surface area lowers the overvoltage requirement. Suitable techniques to roughen the surfaces include sand blasting, chemical etching and the like. The use of chemical etchants is well known and such etchants include most strong inorganic acids, such as hydrochloric acid, sulfuric acid, nitric acid and phosphoric acid. Hydrazine hydrosulfate is also suitable as a chemical etchant.

It is advantageous to degrease the metallic-surfaced substrate with a suitable degreasing solvent prior to roughening the surfaces. Removal of grease deposits from the substrate surfaces is desirable, in many instances, to allow chemical etchants to contact the substrate and uniformly roughen the surfaces thereof. Removal of grease also allows for good contact between the substrate and coating solution to obtain a substantially uniform deposition of metals thereon. Suitable degreasing solvents are most common organic solvents such as acetone and lower alkanes, as well as halogenated hydrocarbon solvents like 1,1,1-trichlorethane marketed commercially as CHLOROTHENE ®brand solvent by The Dow Chemical Company. Removal of grease is also advantageous where roughening of the surfaces is not desired.

Deposition of the electrocatalytic metals onto the surfaces of a substrate is by a non-electrolytic reduction deposition method. In general, deposition is thermodynamically driven and occurs spontaneously by contacting a metal surface with a coating solution of electrocatalytic metal precursor compounds having a pH of less than about 2.8. The contact allows displacement of metal from the substrate surface in exchange for reductive deposition of electrocatalytic metal ions contained in the coating solution.

Coating solutions are formed by ionic dissociation of electrocatalytic metal precursor compounds, as those compounds are defined hereinafter, into a solvent medium. Suitable electrocatalytic metal precursor compounds include metal salts selected from the group consisting of metal halides, sulfates, nitrates, nitrites, phosphates or other soluble compounds. Preferred electrocatalytic metal precursor compounds are metal halide salts, with metal chlorides being the most preferred salts. A suitable solvent medium is one capable of dissolving the electrocatalytic metal precursor compounds and that will allow reductive deposition from the solution to take place. Water is a preferred solvent medium.

Coating solutions include at least one primary electrocatalytic metal precursor compound and, optionally, at least one secondary electrocatalytic metal precursor compound. As used herein, the term "electrocatalytic metal precursor compound" refers to a compound that contains an electrocatalytic metal capable of being deposited onto the metallic-surfaced substrate by non-electrolytic reductive deposition. In general, a suitable electrocatalytic metal is one that is more noble than the metal employed as a substrate, i.e., the electrocatalytic metal precursor compound has a heat of formation that is greater than the heat of formation for the substrate metal in solution. For example, if nickel is selected as the substrate and ruthenium chloride is selected as the electrocatalytic metal precursor compound, non-electrolytic reductive deposition occurs as a result of the following reaction:

$$2RuCl_3+3Ni \rightarrow 2Ru+3NiCl_2$$

The heat of formation for ruthenium trichloride is about −63 kcal/mole, while the heat of formation for nickel dichloride is about −506 kcal/mole. The reaction proceeds due to the greater stability of the products relative to the reactants, i.e., the difference in the heats of formation between ruthenium trichloride and nickel dichloride drives reductive deposition. To obtain suitable results, the difference should be on the order of about 150 kcal/mole and preferably is at least about 300 kcal/mole.

Suitable primary electrocatalytic metal precursor compounds include compounds of platinum group metals, such as ruthenium, rhodium, osmium, iridium and platinum, which are soluble in solvent mediums used to prepare coating solutions as described hereinafter. Preferred compounds are those of platinum and ruthenium, such as platinum chloride, ruthenium chloride, ruthenium nitrate and so on.

The coating solution includes at least one soluble palladium metal precursor compound. The term "palladium metal precursor compound" is an electrocatalytic metal precursor compound wherein palladium is the eleetrocatalytic metal. It has been discovered that the presence of palladium metal ion in the coating solution unexpectedly promotes deposition of electrocatalytic metal onto the metallic-surfaced substrate and, thereby, improves electrocatalyst loading. The term "improved electrocatalyst loading" as used herein means that an effective amount, as defined hereinafter, of electrocatalyst is capable of being applied in a single step, rather than by repeated applications as required by the other methods as previously described. Examples of suitable palladium metal precursor compounds are palladium halides and palladium nitrate.

Secondary electrocatalytic metal precursor compounds may optionally be added to the coating solution to provide additional electrocatalytic effects. However, it is believed that deposition of such metals occurs only to a minor extent, and therefore, the secondary electrocatalytic metals are not essential to the present invention. Secondary electrocatalytic metal precursor compounds correspond to the previous description given for electrocatalytic metal precursor compounds, except metals other than the platinum group metals are the electrocatalytic metals. Secondary electrocatalytic metal precursor compounds include those which contain nickel, cobalt, iron, copper, manganese, molybdenum, cadmium, chromium, tin and silicon. Examples of suitable secondary electrocatalytic metal compounds are nickel halides and nickel acetate.

The concentration of palladium metal ion in the coating solution should be sufficient to promote improved electrocatalyst loading on the metallic-surfaced substrate. The palladium metal precursor compounds are present in an amount sufficient to yield a palladium metal ion concentration in the coating solution of at least about 0.001% by weight of the solution. The palladium metal ion concentration suitably ranges from about 0.001% to about 5%; desirably from about 0.005% to about 2% and preferably from about 0.01% to about 0.05%, by weight of the coating solution. A weight percentage of less than about 0.001% is generally insufficient to promote deposition of the electrocatalytic metals. A weight percentage greater than about 5% results in the deposition of an excessive amount, as defined hereinafter, of electrocatalytic metals on the substrate.

The primary electrocatalytic metal precursor compounds and the optional secondary electrocatalytic metal precursor compounds in the coating solution should be present in amounts sufficient to deposit an effective amount of the metals on the substrate. The concentration of primary electrocatalytic metal ions in the coating solution, in terms of weight percent, is suitably from about 0.01% to about 5%; desirably from about 0.1% to about 2% and preferably from about 0.5% to about 1% by weight of solution. A primary electrocatalytic metal ion concentration of greater than 5% is undesired, because an unnecessarily large amount of the platinum group metals are used to prepare the coating solution. A primary electrocatalytic metal ion concentration of less than 0.01% is undesired, because undesirably long contact times are required. If secondary electrocatalytic metals are desired, the concentration of secondary electrocatalytic metal ions in the coating solution, in terms of weight percent, is suitably up to about 10%; desirably up to about 5% and preferably up to about 1% by weight of solution.

The coating solution should have sufficient acidity to promote deposition. The solution pH suitably is no greater than about 2.8. The pH desirably is no greater than about 2.4 and preferably no greater than about 0.8. A pH above about 2.8 will greatly decrease the rate of deposition by the non-electrolytic reduction deposition process previously described. A pH less than about 0.8 is desirable due to an greatly enhanced rate of deposition relative to a deposition rate at a higher solution pH.

The pH of the coating solution may be adjusted by inclusion of organic acids or inorganic acids therein. Examples of suitable inorganic acids are hydrobromic acid, hydrochloric acid, nitric acid, sulfuric acid, perchloric acid and phosphoric acid. Examples of organic acids are acetic acid, oxalic acid and formic acid. Strong reducing acids such as hydrobromic acid and hydrochloric acid are preferred, because they assist with reduction of the electrocatalytic metal ions.

The temperature of the coating solution varies the rate at which the electrocatalytic metal deposits on the substrate. The temperature suitably ranges from about 25° C. to about 90° C. Temperatures below about 25° C. are not desirable, since uneconomically long times are required to deposit an effective amount of electrocatalytic metal on the substrate. Temperatures higher than about 90° C. are operable, but generally result in an excessive amount of metal deposition. A temperature ranging from between about 40° C. to about 80° C. is desirable, with about 45° C to about 65° C being a preferred temperature range.

Contact between the coating solution and metallic-surfaced substrate is achieved by any convenient method. Typically, at least one surface of the substrate is sprayed with the coating solution, or it may be applied by painting methods, such as application with a brush or a roller. A preferred method is immersion of the substrate in a bath of the coating solution, since the coating solution temperature can be more accurately controlled. Those skilled in the art will recognize that many equivalent methods exist for contacting the substrate with the solution.

The contact time should be sufficient to deposit an effective amount of electrocatalyst on the substrate surfaces. An effective amount of deposition provides an electrocatalytic metal loading of suitably from about 50 micrograms per square centimeter ("$\mu g/cm^2$") up to an amount less than an excessive amount of deposition, as defined hereinafter, of the primary electrocatalytic metal. A desirable loading is from about 400 $\mu g/cm^2$ to about 1800 $\mu g/cm^2$ with a preferred loading of from about 800 $\mu g/cm^2$ to about 1500 $\mu g/cm^2$. Loadings less than about 50 $\mu g/cm^2$ are generally insufficient to provide a satisfactory reduction of cell overvoltage. Loadings greater than an excessive amount of deposition do not significantly reduce the applied overvoltage when compared to reduced catalyst loadings. It should be understood that the effective amount of deposition specified above refers only to loading of the primary electrocatalytic metals and does not include palladium metal or the secondary electrocatalytic metal which may deposit onto the surfaces. This manner of description is due to the difficulty in measuring the relative amounts of each metal on the surface by x-ray fluorescence techniques commonly employed to analyze such coatings. As such, the total amount of metal, i.e., palladium, electrocatalytic metal and secondary electrocatalytic metal, that deposits on the surface will, in most instances, be somewhat higher than the ranges previously specified above which refer to readings observable by x-ray fluorescence.

The deposit of an effective amount of primary electrocatalytic metal, palladium metal and secondary electrocatalytic metal provides a layer having a thickness suitably of from about 0.01 microns to about 15 microns. The layer desirably has a thickness of from about 0.05 microns to about 5 microns and preferably from about 1 micron to about 3 microns. A thickness greater than about 15 microns provides no particular advantage with respect to electrocatalytic effect and, therefore, is not an economical use of the metals employed. The term "excessive amount" as used herein refers to a thickness for this layer of greater than about 15 microns.

Generally, the time allowed for contact between the solution and the metallic-surfaced substrate can suitably vary from about one minute to about 50 minutes. However, it should be understood that the contact time required will vary with coating solution temperature, pH, palladium ion concentration, and the concentration of other metal precursor compounds. Contact times of from about five minutes to about 30 minutes are generally desirable, with from about 10 minutes to about 20 minutes being preferred. Metals will deposit onto the substrate at times of less than one minute, but the amount of deposition is usually insufficient to provide an effective amount of electrocatalytic metals and therefore, requires repeated contact with the coating solution. However, if shorter contact times are desired, the method of the present invention may be repeated a plurality of times until an effective amount of the primary electrocatalytic metals deposit on the metal surfaces of the substrate. However, it is preferred to apply an effective amount of the primary electrocatalytic metals to the substrate surfaces in a single application. Generally, times in excess of about 50 minutes provide no discernible advantage, because an unnecessary and excessive amount of metal will deposit.

Figure 2:
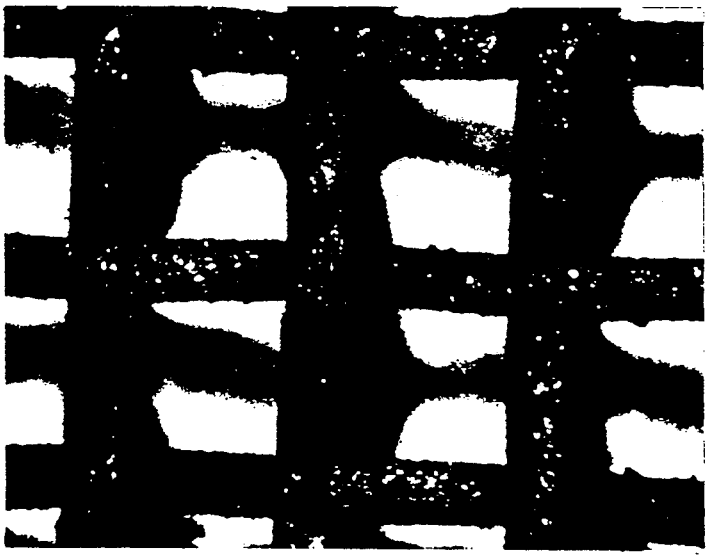
FIG. 2 is a photomicrograph of a coating which displays a soft, powder-like and dendritic surface deposit. The coating is discussed in connection with Comparative Example E.

It has been observed that times in excess of about 50 minutes are also undesirable, because the outer surface of the resulting deposit, on its outer surface, may develop a dull, soft, dendritic and powder-like consistency as illustrated, for example, in FIG. 2. As such, the soft outer surface of the deposit is easily abraded and dislodged therefrom and, therefore, is an uneconomical use of the metals employed. However, it is believed that underneath this soft outer surface is a hard, substantially continuous layer of electrocatalytic metal.

It is advantageous to rinse the coated substrate with water or other inert fluid after contact with the coating solution, especially where a strong inorganic acid, such as hydrochloric acid, is incorporated in the coating solution. The rinse minimizes possible removal of deposited metals from the coated substrate due to corrosive action by the acid.

After the coating operation and optional rinse as previously described, it may be beneficial, but not essential, to heat the coated substrate in an oxidizing environment. It is believed that thermal treatment of the coated substrate serves to anneal the metal coating and, to some extent, converts any residual electrocatalytic metal precursor compounds remaining thereon to their corresponding metal oxides. A suitable method is to heat the coated substrate in an oven in the presence of air. Thermal oxidation methods are taught in U.S. Pat. No. 4,584,085, the relevant teachings of which are incorporated herein by reference.

Temperatures at which the metal precursor compounds thermally oxidize depend to a limited extent upon the nature of the metal precursor compounds employed in a given coating solution. In general, suitable temperatures range from about 300° C. to about 650° C. It is preferred to conduct thermal oxidation at a temperature of from about 450° C. to about 550° C., because in that range substantially all residual electrocatalytic metal precursor compounds are converted to metal oxides. The time required for this heat treatment is not particularly critical and may suitably range from about 20 minutes to about 90 minutes.

The metals deposited according to the invention form a hard, substantially continuous and non-dendritic coating of a metal alloy that comprises palladium metal, at least one electrocatalytic metal and, optionally, at least one secondary electrocatalytic metal. A typical coating is illustrated by FIG. 1. By the term "metal alloy" it is meant that the metals deposit to form a substantially uniform composition on the surfaces of the substrate. The coating deposited as described above is not easily abraded from the surfaces of the underlying substrate, thereby indicating that the coating is tightly adherent thereto. The coated substrate is useful as a low hydrogen overvoltage cathode in an electrolytic cell.

SPECIFIC EMBODIMENTS OF THE INVENTION

The following examples illustrate the present invention and should not be construed, by implication or otherwise, as limiting the scope of the appended claims.

EXAMPLES 1–4

A coating solution is prepared by mixing 6.335 grams (1.943% by weight of the resulting solution) of ruthenium trichloride monohydrate, a primary electrocatalytic metal precursor compound; 0.072 grams (0.022% by weight) of palladium dichloride, a palladium metal precursor compound: 6.010 grams (1.843% by weight) of nickel dichloride hexahydrate, a secondary electrocatalytic metal precursor compound and 13.550 grams (4.158% by weight) of a concentrated 37% by weight aqueous hydrochloric acid solution, an etchant and pH adjustment means, with 300 grams (92.03% by weight) of water, a solvent medium. The above ingredients are placed in a glass beaker and stirred overnight to dissolve the solid metal precursor compounds.

A woven nickel wire screen is selected for use as a metallic-surfaced substrate for each of these examples. The nickel wire has a diameter of 0.010 inches and is woven to produce a screen having 25 strands of wire per inch. The wire screen is cut to provide four substrates, each of which measure three inches by three inches. Prior to contact with the coating solution, each substrate is degreased by immersion in CHLOROTHENE® brand solvent, i.e. 1,1,1-trichlorethane, which is commercially available from The Dow Chemical Company.

In Example 1, a cathode is prepared by contacting one of the woven nickel wire screen substrates with the previously described coating solution. A 4 inch petri dish is first filled with 25 milliliters of the coating solution. The petri dish is then covered to prevent evaporation of water and placed into a 10 liter temperature controlled water bath maintained at about 45° C. The petri dish is left in the bath for about 5 minutes to allow the coating solution to equilibrate to the bath temperature. Thereafter, the dish is removed and the substrate, previously described, is placed horizontally into the petri dish such that it is completely immersed in the coating solution. The petri dish is then covered and immediately returned to the bath for about 10 minutes. Following immersion in the coating solution, the substrate is rinsed with water and the side of the substrate in contact with the bottom of the petri dish is noted.

The above procedure is substantially repeated with respective wire screen substrates for Examples 2–4, respectively, except for maintaining the bath temperature at a different temperature. In Example 2, the bath is maintained at about 55° C. In Example 3, the bath is maintained at about 65° C. In Example 4, the bath is maintained at about 75° C.

The four resulting coated substrates are then analyzed to determine the loading of elemental ruthenium thereon. The ruthenium loading is measured by x-ray fluorescence using a Texas Nuclear Model #9256 digital analyzer. The analyzer is equipped with a cadmium 109, 5 millicurie source, and filters commercially available from Texas Nuclear that are optimized for measuring ruthenium in the presence of nickel. The analyzer provides a measurement which is compared with a standard having a known ruthenium loading of 754.8 μg/cm2 to arrive at a measured loading for each substrate. Measurements using the analyzer are taken at the center of the substrate on both sides of the screen, with both measurements being used to calculate an average ruthenium loading. The loadings of ruthenium metal for the substrate upper surface, substrate lower surface and an average for these two surfaces in Examples 1–4 are given in Table 1. The term "upper" refers to loading of ruthenium on the portion of the screen surface in contact with the bulk solution, while the term "lower" refers to loading on the portion of the screen in contact with the inside bottom surface of the petri dish.

To analyze operation of the coated substrates in a chlor-alkali cell environment, the coated substrates are each tested as cathodes in a test bath containing approximately 32% aqueous sodium hydroxide solution maintained at a temperature of about 90° C. Each cathode is attached to a current distributing electrode made of 0.070 inch thick, 40% expanded nickel mesh which is connected to a negative current source and immersed into the test bath. A three inch by three inch piece of platinum foil is used as an anode. The anode is placed within an envelope of Nafion®, a perfluorosulfonic acid ion exchange membrane material, available commercially from the E. I. duPont deNemours & Co., and is then immersed in the test bath. The cells are operated at a current density of about 2.0 amps per square inch, or about 0.31 amps per square centimeter, to produce oxygen gas at the anode and hydrogen gas and aqueous sodium hydroxide at the cathode.

The potentials for each cathode are measured after about 20 minutes of steady state operation under the above described conditions. The cathode potentials are measured using a mercury/mercuric oxide reference electrode and a Luggin probe at the previously given current density. The results of the cathode potential measurements are reported in Table 1. After one hour of electrolysis, the cathodes are removed from the bath and the loading of ruthenium remaining after electrolysis is determined in the same manner as previously described. The loading of ruthenium after electrolysis, as well as the calculated ruthenium loss, for each cathode is also reported in Table 1.

TABLE 1

Data for Examples 1-5 and Comparative Examples A-D

| Example No. | Bath Temp. (°C.) | Pd Content of Coating Solution (Wt. %) | Upper Ru Loading (μg/cm²) | Lower Ru Loading (μg/cm²) | Average Ru Loading Before Electrolysis (μg/cm²) | Average Ru Loading After Electrolysis (μg/cm²) | Ru Loss (μg/cm²) | Cathode Potential (volts) |
|---|---|---|---|---|---|---|---|---|
| 1 | 45 | 0.022 | 241 | 131 | 186 | 178 | 8 | −1.045 |
| 2 | 55 | 0.022 | 514 | 372 | 443 | 394 | 49 | −1.035 |
| 3 | 65 | 0.022 | 572 | 466 | 519 | 478 | 41 | −1.007 |
| 4 | 75 | 0.022 | 1380 | 1139 | 1260 | 986 | 274 | −1.007 |
| 5 | 45 | 0.185 | 947 | 613 | 780 | 449 | 331 | −1.019 |
| A | 45 | 0 | 16 | 16 | 16 | 16 | 0 | −1.128 |
| B | 55 | 0 | 37 | 25 | 31 | 30 | 1 | −1.095 |
| C | 65 | 0 | 318 | 274 | 296 | 268 | 28 | −1.053 |
| D | 75 | 0 | 857 | 808 | 833 | 806 | 27 | −1.002 |

The results indicate that deposition is dependent upon temperature. FIG. 1 illustrates a coating obtained by Example 2 which is a shiny, hard, substantially continuous and non-dendritic coating that is tightly adhered to the substrate.

COMPARATIVE EXAMPLES A-D

Preparation of Cathodes From Palladium-Free Coating Solutions

The procedure of Examples 1-4 is substantially repeated using four additional wire screen substrates, except that the coating solution employed does not contain dissolved palladium dichloride. The coating solution used is prepared by mixing 3.153 grams (1.935% by weight) of ruthenium trichloride monohydrate, 3.030 grams (1.859% by weight) of nickel dichloride hexahydrate, and 6.757 grams (4.146% by weight) of a concentrated 37% by weight aqueous hydrochloric acid solution with 150 grams (92.05% by weight) of water. The ruthenium loadings and cathode potentials are measured as in Examples 1-4 and are recorded in Table 1 for comparison therewith.

Comparative Examples A-D show, when compared to the catalyst loadings of Examples 1-4, that inclusion of palladium metal ions in the coating solution increases the amount of ruthenium deposited on the substrate.

EXAMPLE 5

Preparation of a Cathode From a Coating Solution Having A Higher Concentration of Palladium The procedure followed in Examples 1-4 is substantially repeated upon one additional substrate, except that the cathode is prepared from a coating solution having a higher concentration of palladium metal ion. The coating solution employed in this example is prepared by mixing 3.158 grams (1.934% by weight) of ruthenium trichloride monohydrate, 0.303 grams (0.185% by weight) of palladium dichloride, 3.007 grams (1.842% by weight) of nickel dichloride hexahydrate and 6.768 grams (4.146% by weight) of a concentrated 37% by weight aqueous hydrochloric acid solution with 150 grams (91.89% by weight) of water. The contact between the substrate and coating solution is at a bath temperature of about 45° C. As in Examples 1-4, the ruthenium loading and cathode potential are measured and recorded in Table 1 for comparison therewith.

Comparison between ruthenium loadings for Example 1 and Example 5 shows that a higher concentration of palladium metal ion in the coating solution results in a corresponding increase in ruthenium deposition.

EXAMPLES 6-9 and Comparative Example E

Effect of Immersion Time Upon Amount of Catalyst Deposition

The coating solution made in Examples 1-4 is used in Examples 6-9 and Comparative Example E. The general procedure of Examples 1-4 is substantially repeated using five additional substrates, except that the temperature at which the substrates and the coating solution are contacted is maintained at a fairly constant temperature, while the immersion times are varied. The bath temperature is maintained at about 55° C. to about 60° C. The immersion times for Examples 6-9 and Comparative Example E are 2, 8, 20, 50 and 120 minutes respectively. The resulting coatings are not operated as cathodes in the test bath. The measured ruthenium loadings are given in Table 2.

TABLE 2

Data for Examples 6-9 and Comparative Example E

| Example No. | Immersion Time (min.) | Upper Ru Loading (μg/cm²) | Lower Ru Loading (μg/cm²) | Average Ru Loading (μg/cm²) |
|---|---|---|---|---|
| 6 | 2 | 99 | 69 | 84 |
| 7 | 8 | 385 | 252 | 318 |
| 8 | 20 | 893 | 681 | 787 |
| 9 | 50 | 1978 | 1682 | 1830 |
| E | 120 | 4134 | 3099 | 3616 |

The coatings obtained by Examples 6-9 exhibit a shiny, hard, substantially continuous and non-dendritic deposit which is not easily removed by vigorous rubbing or abrasion. In contrast, the coating obtained by Comparative Example E exhibits, on its surface, a dull, soft, powder-like and dendritic deposit which is easily removed by rubbing. The upper surface of the coated substrate in Comparative Example E, i.e., the surface exposed to the bulk coating solution while immersed in the petri dish, is illustrated by FIG. 2. These examples illustrate that a suitable coating, i.e., one having an effective amount of catalyst and a substantially hard surface, is obtained under conditions presented in Examples 6-9 at an immersion time of about 50 minutes or less. If the substrate is, for example, contacted with this coating solution for about 120 minutes, the resulting deposit, on its surface, is soft, dendritic and powder-like and, therefore, susceptible to loss during cell operation.

What is claimed is:

1. A method of making an electrocatalytic cathode comprising contacting at least one surface of a metallicsurfaced substrate with a coating solution having a pH of less than about 2.8, the coating solution comprising a solvent medium, at least one primary electrocatalytic metal ion at a concentration sufficient to deposit an effective amount of at least one primary electrocatalytic metal on the surfaces, and palladium metal ion at a concentration sufficient to promote deposition of the at least one primary electrocatalytic metal in admixture with palladium metal on the surfaces, the contact being conducted under conditions and for a time sufficient to deposit on the surfaces, by non-electrolytic reduction deposition, a hard, substantially continuous and nondendritic coating of the at least one primary electrocatalytic metal and palladium metal as a metal alloy having a substantially uniform composition, the deposition of the at least one primary electrocatalytic metal being increased in comparison to use of an otherwise similar palladium-free coating solution under substantially similar conditions.

2. The method of claim 1 wherein the palladium metal ion concentration is from about 0.001% to about 5% by weight of the solution.

3. The method of claim 1 wherein the palladium metal ion concentration is from about 0.01% to about 0.05% by weight of the solution.

4. The method of claim 1 wherein the primary electrocatalytic metal ion concentration is from about 0.01% to about 5% by weight of the solution.

5. The method of claim 1 wherein the solvent medium is water.

6. The method of claim 1 wherein the primary electrocatalytic metal ion is selected from the group consisting of ruthenium, rhodium, osmium, iridium, platinum, and mixtures thereof.

7. The method of claim 1 wherein the primary electrocatalytic metal ion is ruthenium.

8. The method of claim 1 wherein the coating solution further comprises at least one secondary electrocatalytic metal ion selected from the group consisting of nickel, cobalt, iron, copper, manganese, molybdenum, cadmium, chromium, tin and silicon ions.

9. The method of claim 8 wherein the coating solution has a secondary electrocatalytic metal ion concentration of no greater than about 10% by weight of the solution.

10. The method of claim 1 wherein the metallic-surfaced substrate comprises a metal selected from the group consisting of nickel, iron, steel, stainless steel, copper, and alloys thereof.

11. The method of claim 1 wherein the metallic-surfaced substrate comprises nickel.

12. The method of claim 1 wherein the metallic-surfaced substrate is a laminate comprising a base layer of an underlying material with a layer of metal selected from the group consisting of nickel, iron, steel, stainless steel, copper, and alloys thereof affixed to the underlying material.

13. The method of claim 1 wherein the contact occurs for a time of from about 1 minute to about 50 minutes.

14. The method of claim 1 wherein the contact occurs for a time of from about 10 minutes to about 20 minutes.

15. The method of claim 1 wherein the pH is no greater than about 0.8.

16. The method of claim 1 wherein the conditions include a coating solution temperature of from about 25° C. to about 90° C.

17. The method of claim 1 wherein the conditions include a coating solution temperature of from about 45° C. to about 65° C.

18. The method of claim 1 wherein the amount deposited produces a coating having from about 50 $\mu g/cm^2$ up to an amount less than an excessive amount of the primary electrocatalytic metal.

19. The method of claim 1 wherein the amount deposited produces a coating having from about 800 $\mu g/cm^2$ to about 1500 $\mu g/cm^2$ of the primary electrocatalytic metal.

20. The method of claim 1 wherein the coating has a thickness of from about 0.01 microns to about 15 microns.

21. The method of claim 1 wherein the coating has a thickness of from about 1 micron to about 3 microns.

22. The method of claim 1 which further comprises heating the substrate in an oxidizing environment at a temperature of from about 300° C. to about 650° C. and for a time of from about 20 minutes to about 90 minutes after contact with the coating solution.

23. The method of claim 22 wherein the temperature is from about 450° C. to about 550° C.

24. The method of claim 1 wherein the effective amount is obtained by repeated contact between the surfaces and the coating solution.

25. A cathode produced according to claim 1.

* * * * *